US006380504B1

(12) United States Patent
Klocke et al.

(10) Patent No.: US 6,380,504 B1
(45) Date of Patent: Apr. 30, 2002

(54) POLYPHASE HIGH VOLTAGE SWITCH WITH OPERATING MECHANISM INCLUDING TIME DELAY

(75) Inventors: Christian Klocke; Gunnar Lutzke, both of Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/526,365

(22) Filed: Mar. 16, 2000

(30) Foreign Application Priority Data

Mar. 17, 1999 (DE) ..... 199 13 059

(51) Int. Cl.[7] ..... H01H 33/02; H01H 33/42
(52) U.S. Cl. ..... 218/153; 218/154
(58) Field of Search ..... 218/1–6, 7, 14, 218/78, 84, 92, 120, 152, 153, 154

(56) References Cited

U.S. PATENT DOCUMENTS 4,225,763 A * 9/1980 Barkan ..... 218/120
4,814,560 A * 3/1989 Akesson ..... 218/84
5,510,590 A * 4/1996 Hux ..... 218/6
5,569,891 A * 10/1996 Freeman et al. ..... 218/154 X
5,600,112 A * 2/1997 Opfer ..... 218/154
5,604,340 A * 2/1997 Yamada et al. ..... 218/154 X
5,889,248 A * 3/1999 Plettner et al. ..... 218/7
5,936,213 A * 8/1999 Biquez et al. ..... 218/7 X

FOREIGN PATENT DOCUMENTS

DE 195 24 636 9/1996

* cited by examiner

*Primary Examiner*—J. R. Scott
(74) *Attorney, Agent, or Firm*—Kenyon & Kenyon

(57) ABSTRACT

In a high-voltage circuit breaker, in particular having three poles, each circuit-breaker pole having at least one interrupter unit whose actuatable switching contact can be actuated by a joint actuating mechanism via a switching rod so that in the event of a closing operation there is a time delay at least between the closing of the interrupter units of two circuit-breaker poles. The switching rods of the second and/or third circuit-breaker pole are connected to the actuating mechanism via spring elements that are compressible in the event of a closing operation and expand after contact has been made.

6 Claims, 2 Drawing Sheets

POLYPHASE HIGH VOLTAGE SWITCH WITH OPERATING MECHANISM INCLUDING TIME DELAY

FIELD OF THE INVENTION

The present invention relates to a high-voltage circuit breaker having at least two circuit-breaker poles, in particular having three poles, each circuit-breaker pole having at least one interrupter unit whose actuatable switching contact can be actuated by a joint actuating mechanism via a switching rod so that in the event of a closing operation there is a time delay at least between the closing of the interrupter units of two circuit-breaker poles. At least the switching rod of a first circuit-breaker pole being is connected to the actuating mechanism via a lever.

BACKGROUND INFORMATION

A high-voltage circuit breaker is described in, for example, German Patent No. 195 24 636. As described therein, the actuatable switching contacts of the interrupter units are actuated by a joint actuating mechanism via switching rods. The actuatable switching contact of the interrupter unit of a first circuit-breaker pole is connected to an actuating shaft directly via the switching rod and a lever, and the actuatable switching contacts of the second and third circuit-breaker poles are actuated by actuating shafts assigned to these circuit-breaker poles. These actuating shafts are connected to the actuating shaft that can be actuated by the actuating mechanism.

In order to achieve a time delay between the closing of the interrupter unit of one circuit-breaker pole and that of the next, the levers that are connected to one another via the connector rods and the lever that is rigidly attached to the actuating shaft assigned to the first circuit-breaker pole have actuating lever arms of unequal length. Furthermore, these levers are not arranged parallel to one another but rather are arranged at an angle adapted to one another. Because the interrupter units are closed subject to a time delay, it is possible, for example, to switch capacitor banks into the circuit when the phase voltage in question passes through zero or to switch transformers into the circuit when the phase voltage in question reaches a maximum. However, it is disadvantageous that this is achieved by providing a plurality of levers of different lengths. In addition, arranging them on the actuating shafts involves considerable expense, because each lever has to be arranged at a different angle relative to the actuating shafts. Nonetheless, in the case of this high-voltage circuit breaker, the interrupter units are opened subject to a time delay between one circuit-breaker pole and the next.

SUMMARY

An object of the present invention is to create provide a high-voltage circuit breaker which allows assembly costs and the number of components to be reduced and in which, in the event of a closing operation, the interrupter unit of one circuit-breaker pole closes subject to a time delay or the interrupter units close subject to a time delay between one circuit-breaker pole and the next.

According to the present invention, this is achieved in that only the switching rod of the second and/or third circuit-breaker pole is connected to the actuating mechanism via spring elements that are compressible in the event of a closing operation and expand after contact has been made.

According to an advantageous embodiment the respective spring elements are arranged in a recess of a sleeve and are delimited by a shoulder of the recess and by the shoulder of a collar of a coupling rod that extends into the recess or of a switching rod.

According to an example refinement of the present invention, the sleeve that holds the spring elements has a bearing via which it is connected to a lever that is rigidly attached to the actuating shaft, and the coupling rod that extends into the recess of the sleeve has a second bearing via which it is connected to a lever that is rigidly attached to a second actuating shaft, the second actuating shaft being connected to the switching rod assigned to the interrupter unit of the second circuit-breaker pole.

If a first sleeve of this kind is assigned to only one circuit-breaker pole of a three-pole high-voltage circuit breaker, ungrounded capacitor banks can be optimally connected into the circuit. This means the jump-like increase in the voltage of the third phase that occurs in the case of synchronous closing can be avoided, because the interrupter unit of the circuit-breaker pole to which the spring elements are assigned closes subject to a time delay. The switching rods of the other two circuit-breaker poles are directly connected via levers to the actuating shaft that can be actuated by the actuating mechanism.

In the case of a synchronous closing operation in a three-pole high-voltage circuit breaker, the substantial dielectric and mechanical load on a device connected in a three-phase system can be reduced in that the interrupter units are closed subject to a time delay between one circuit-breaker pole and the next, so that the interrupter units are closed as the current wave passes through zero.

To accomplish this, according to a further embodiment of the present invention, a second sleeve which holds the spring elements in a recess and which on one side is indirectly and rigidly attached to the first sleeve via a coupling rod that extends into the recess, the first sleeve being connected to the actuating shaft via the bearing and the lever, and on the other side is connected via a bearing to a lever that is rigidly attached to a third actuating shaft that is connected to the switching rod assigned to the interrupter unit of the third circuit-breaker pole, is arranged axially downstream from the first sleeve.

As the switching rods of two circuit-breaker poles are connected to the actuating mechanism via spring elements that are compressible in the event of a closing operation, the spring elements have different spring deflections and/or different spring characteristics in order to ensure that the interrupter units are closed subject to a time delay from one circuit-breaker pole to the next. If spring elements having different spring characteristics are used, the spring elements having the least stiff spring characteristic are assigned to the switching rod of the circuit-breaker pole having the longest time delay in the event of a closing operation. Cup springs may be used as the spring elements.

If compressible spring elements are assigned to a second and third circuit-breaker pole, the coupling rod that extends into the recess of the second sleeve is rigidly connected to the first sleeve, which is connected to the actuating shaft via a bearing; because of this, inside the recess of the second sleeve the spring elements are delimited on one side by a shoulder of a collar of the associated coupling rod. On the front end of the sleeve, on the opposite side from the shoulder of the collar of the coupling rod, the deflection of the spring elements is delimited by a stop element. As a result, in the event of a closing procedure, in which the coupling rod of the second sleeve functions as a pull rod, the spring elements in both sleeves are compressed.

In the event of a switching operation, to ensure the switching movement caused by the actuating mechanism is transferred, a further lever is rigidly attached to the second and third actuating shafts, respectively. These levers are connected to the switching rods of the second and third circuit-breaker poles.

Given that in the event of a closing operation the compressible spring elements expand after contact has been made, when an opening operation is initiated the sleeves can be immediately carried along by the lever that is rigidly attached to the actuating shaft without any time delay. This is accomplished in that when the opening operation is initiated, the sleeve is carried along due to the fact that the collar of the coupling rod rests against a stop element at the front end of the sleeve opposite the shoulder of the recess.

The desired functioning of the present invention can also be achieved if the sleeve that holds the spring elements is integrated into the switching rod of the second and/or third circuit-breaker pole.

Sleeves may also be assigned in this way in the case of one circuit-breaker pole or two circuit-breaker poles of a three-pole high-voltage circuit breaker.

DETAILED DESCRIPTION

Figure 1:
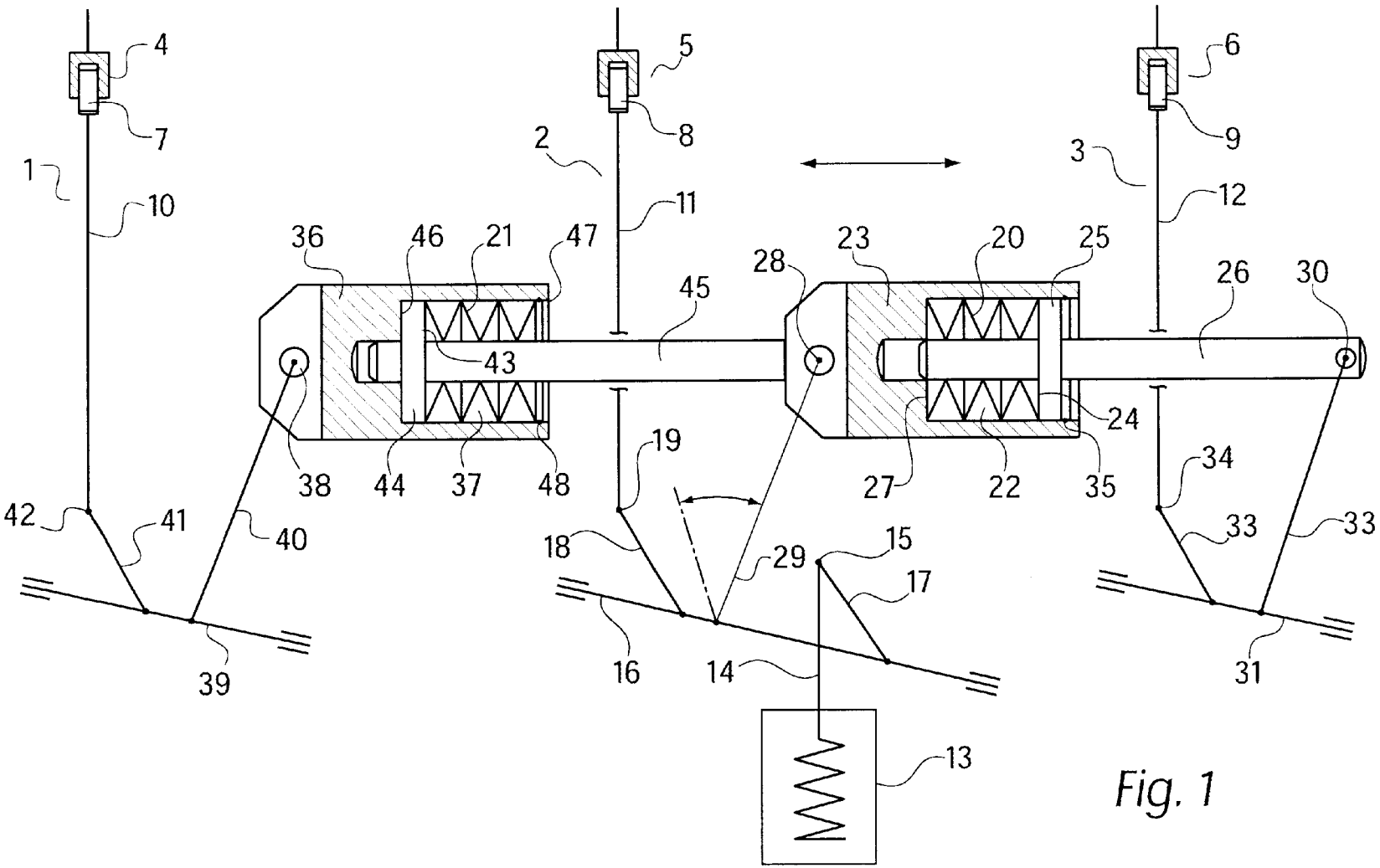
FIG. 1 shows a schematic drawing of a three-pole high-voltage circuit breaker having a device for closing interrupter units so that there is a time delay between one circuit-breaker pole and the next; a section through the device being shown.

The high-voltage circuit breaker shown in FIG. 1 has three circuit-breaker poles 1, 2, 3, each having an interrupter unit 4, 5, 6. Actuatable switching contacts 7, 8, 9 of interrupter units 4, 5, 6 are each connected to a switching rod 10, 11, 12, respectively, via which switching contacts 7, 8, 9 can be actuated by actuating mechanism 13 when a switching operation is initiated. Herein, actuating rod 14 of actuating mechanism 13 is connected to a lever 17, which is rigidly attached to actuating shaft 16 via a bearing 15. A further lever 18 is rigidly attache d to actuating shaft 16 and is connected to switching rod 11 of circuit-breaker pole 2 via a bearing 19. Thus when a switching operation is initiated by rotating actuating shaft 16 via lever 17, actuatable switching contact 8 of interrupter unit 5 of circuit-breaker pole 2 is actuated with no time delay.

In the case of a closing operation, to ensure actuatable switching contacts 7, 9 of interrupter units 4, 6 of circuit-breaker poles 1, 3 are actuated subject to a time delay relative to actuatable switching contact 8 of interrupter unit 5 of circuit-breaker pole 2, switching rods 10, 12 of circuit-breaker poles 1, 3 are connected to actuating mechanism 13 via spring elements 20, 21 that are compressible in the event of a closing operation. Herein, spring elements 20 assigned to switching rod 12 of circuit-breaker pole 3 are arranged in a recess 22 of a sleeve 23. Inside recess 22 spring elements 20 are delimited in terms of their spring deflection by a shoulder 24 of a collar 25 of a coupling rod 26 that extends into recess 22 and by shoulder 27 of recess 22. Sleeve 23 has a bearing 28 via which it is connected to a lever 29, which is rigidly attached to actuating shaft 16. Thus, when actuating shaft 16 is actuated by actuating mechanism 13 lever 29 shifts sleeve 23 axially. Coupling rod 26 also has a bearing 30. Coupling rod 26 is connected via this bearing to a lever 32, which is rigidly attached to a second actuating shaft 31. A further lever 33 is rigidly attached to second actuating shaft 31 and is connected to switching rod 12 of circuit-breaker pole 3 via bearing 34. Because the high-voltage circuit breaker shown in FIG. 1 is shown in the closed position, spring elements 20 inside recess 22 of sleeve 23 have assumed a position in which they are expanded. Herein, the path of coupling rod 26 is delimited by the fact that its collar 25 rests against stop element 35. This ensures that if an opening operation is initiated switching contact 9 is also actuated with no time delay. If a closing operation is initiated, sleeve 23 is immediately shifted axially by lever 29 which is rigidly attached to actuating shaft 16, but coupling rod 26 is not axially shifted until spring elements 20 have become compressed so that coupling rod 26 is carried along. Once the coupling rod is carried along, interrupter unit 6 of second circuit-breaker pole 3 is also closed via lever 32, second actuating shaft 31, lever 33 and switching rod 12. The time difference between the closing of interrupter units 5, 6 of circuit-breaker poles 2, 3 may be specified by arranging spring elements 20.

Furthermore, as shown in FIG. 1, first sleeve 23 is arranged upstream from a second sleeve 36, whose recess 37 holds spring elements 21 which are compressible in the event of a closing operation and via which switching rod 10 of circuit-breaker pole 1 is connected to actuating mechanism 13. On one side sleeve 36 is indirectly connected to sleeve 23, and on the other side it is connected via a bearing 38 to a lever 40, which is rigidly attached to a third actuating shaft 39. The connection to switching rod 10 of circuit-breaker pole 1 is made via a further lever 41, which is rigidly attached to third actuating shaft 39, and via a bearing 42. Spring elements 21 arranged in recess 37 of second sleeve 36 are delimited by a shoulder 43 of a collar 44 of a coupling rod 45 which extends into recess 37 and by a stop element 48. Coupling rod 45 is rigidly attached to sleeve 23.

Starting from the closed position of the high-voltage circuit breaker shown in FIG. 1, when an opening operation is initiated second sleeve 36 is axially shifted by sleeve 23 via coupling rod 45 and thus by collar 44, which is resting against shoulder 46 of recess 37, with no time delay. This means actuatable switching contact 7 of interrupter unit 4 of circuit-breaker pole 1 is also actuated with no time delay. Actuation is accomplished via lever 40, third actuating shaft 39, lever 41 and by switching rod 10. In the event of a closing operation, second sleeve 36 is not carried along by sleeve 23 and thus by coupling rod 45, which is now functioning as a pull rod, until compression of spring elements 21 inside recess 37 of sleeve 36 has been completed. Once the second sleeve is carried along, interrupter unit 4 of circuit-breaker pole 1 is also closed. To ensure that interrupter units 4, 5, 6 of circuit-breaker poles 1, 2, 3 are closed subject to a time delay with respect to one another, spring elements 20, 21, which are compressible in the event of a closing operation, have different spring characteristics. They may also have spring deflections.

Figure 2:
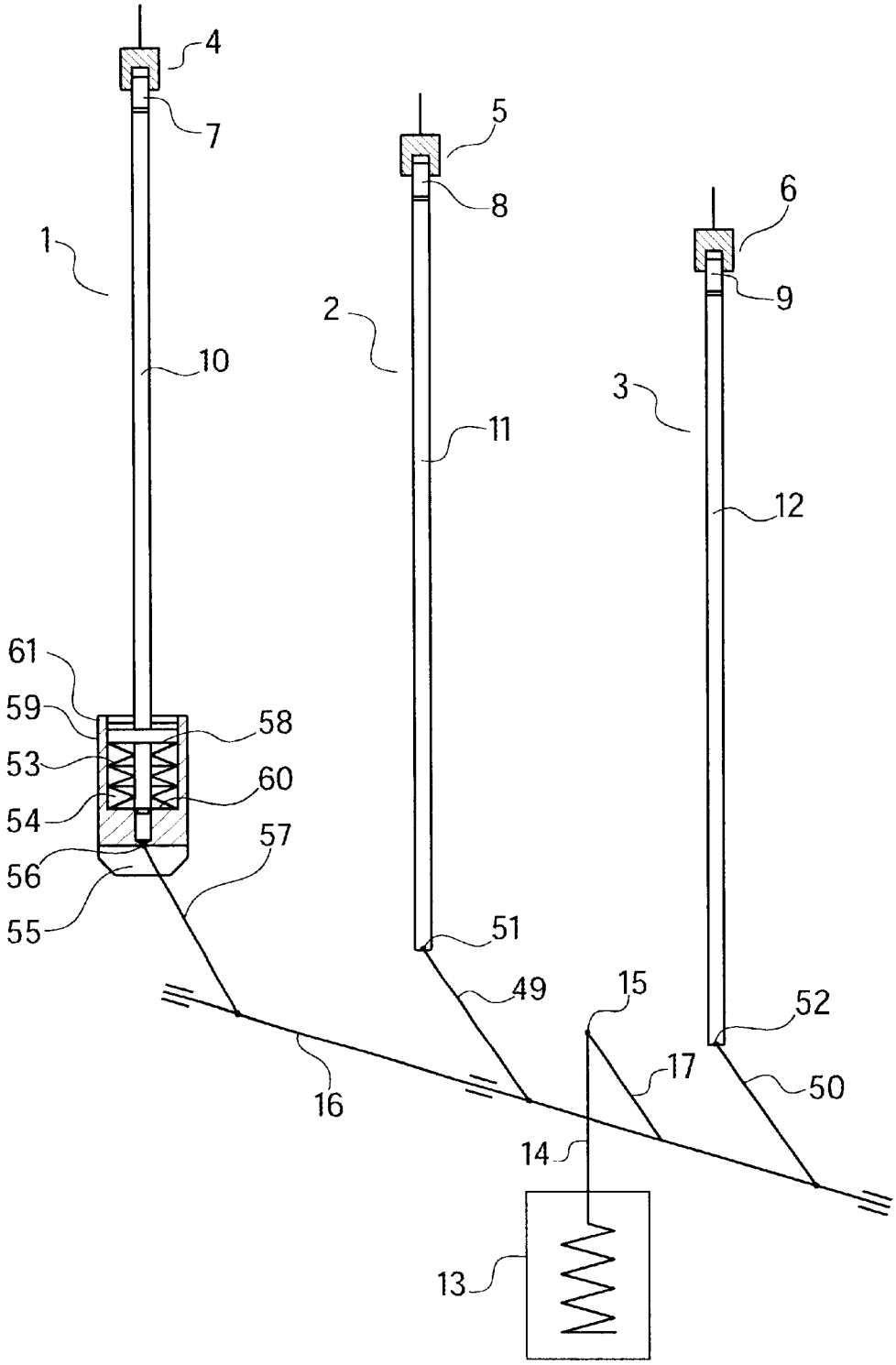
FIG. 2 shows a schematic drawing of a three-pole high-voltage circuit breaker having a device for time-delayed closing that differs from the one shown in FIG. 1.

The high-voltage circuit breaker shown in FIG. 2 also includes three circuit-breaker poles 1, 2, 3, each having an interrupter unit 4, 5, 6, respectively. As before, in the case of this high-voltage circuit breaker, which is shown in the closed position, actuatable switching contacts 7, 8, 9 of interrupter units 4, 5, 6 are each connected to a switching rod 10, 11, 12, respectively. In contrast to the high-voltage circuit breaker shown in FIG. 1, in the event of a switching operation, in addition to actuatable switching contact 8 of interrupter unit 5 of circuit-breaker pole 3, actuatable switching contact 9 of interrupter unit 6 of circuit-breaker pole 3 is also directly actuated by actuating mechanism 13 via actuating shaft 16. On one side actuating shaft 16 is connected to levers 49, 50 which are rigidly attached to it and are connected to switching rods 11, 12 via bearings 51, 52. On the other side of actuating shaft 16 a further lever 17 is rigidly attached and is connected to actuating rod 14 of actuating mechanism 13 via bearing 15, so that actuating shaft 16 is actuated by actuating mechanism 13 via lever 17. This means that not only in the event of a closing operation but also in the event of an opening operation interrupter units 5, 6 of circuit-breaker poles 2, 3 are respectively closed and opened simultaneously.

To ensure that interrupter unit 4 of circuit-breaker pole 1 is closed subject to a time delay relative to interrupter units 5, 6 of circuit-breaker poles 2, 3, switching rod 10 of circuit-breaker pole 1 is connected to actuating mechanism 13 via compressible spring elements 53, which expand after contact has been made. Spring elements 53 are arranged in a recess 54 of a sleeve 55, the design of sleeve 55 being the same as that of sleeve 23 that holds spring elements 20 shown in FIG. 2. However, instead of coupling rod 26 shown in FIG. 1, switching rod 10 of circuit-breaker pole 1 extends into recess 54 of sleeve [5] 55, which is thus integrated into switching rod 10. Sleeve 55 is connected to actuating shaft 16 via bearing 56 and lever 57, which is rigidly attached to actuating shaft 16.

Inside recess 54 of sleeve 55, spring elements 53 are also delimited by a shoulder 58 of a collar 59 of switching rod 10 and by shoulder 16 of recess 54. After spring elements 53 have expanded, collar 59 of switching rod 10 lies against a stop element 61. Thus, when an opening operation is initiated, not only sleeve 55 but also switching rod 10 are carried along by lever 57 with no time delay, so that actuatable switching contact 7 of interrupter unit 4 of circuit-breaker pole 1 is also actuated with no time delay. When a closing operation is initiated, sleeve 55 is carried along via lever 57 and thus via fulcrum 56 with no time delay, but switching rod 10 is not carried along until spring elements 53 have been compressed, so that interrupter unit 4 of circuit-breaker pole 1 closes subject to a time delay relative to interrupter units 5, 6 of circuit-breaker poles 2, 3.

In the case of this high-voltage circuit breaker, if it is desired that interrupter units 4, 5, 6 of circuit-breaker poles 2, 1 be closed subject to a time delay relative to circuit-breaker poles 1, 3, it is possible, for example, also to connect switching rod 12 of circuit-breaker pole 3 to actuating mechanism 13 using spring elements that are compressible in the event of a closing operation and via a similar connection to that used for switching rod 10 of circuit-breaker pole 1. The spring elements assigned to circuit-breaker poles 1, 3 have different spring deflections or different spring characteristics.

What is claimed is:

1. A high-voltage circuit breaker, comprising:

three circuit breaker poles; and at least one interrupter unit for each of the circuit-breaker poles, each of the at least one interrupter unit having an actuatable switching contact which is actuated by a joint actuating mechanism via a respective switching rod so that in the event of a closing operation, a time delay is provided at least between a closing of the interrupter units of two of the circuit breaker poles, at least the respective switching rod of a first one of the circuit-breaker poles being connected to the actuating mechanism via levers, only at least one of a second one of the circuit-breaker poles and a third one of the circuit-breaker poles is connected to the actuating mechanism via spring elements, the spring elements being compressible in the event of the closing operation and expand after contact has been made.

2. The high-voltage circuit breaker according to claim 1, further comprising:

sleeves, each of the spring elements being arranged in a respective recess of one of the sleeves; and a coupling rod extending into a recess of the sleeve, the spring elements being delimited by a shoulder of the recess and by a shoulder of a collar of the coupling rod.

3. The high-voltage circuit breaker according to claim 1, further comprising:

sleeves, each of the spring elements being arranged in a recess of one of the sleeves and being delimited by a shoulder of the recess and by the respective switching rod.

4. The high-voltage circuit beaker according to claim 3, wherein the sleeves are integrated into the respective switching rod of at least one of: i) the second circuit-breaker pole, and ii) the third circuit-breaker pole.

5. The high-voltage circuit breaker according to claim 1, wherein the respective switching rod of the second one of the circuit-breaker poles and the third one of the circuit-breaker poles are connected to the actuating mechanism via respective ones of the spring elements, each of the respective ones of the spring elements being compressible in the event of the closing operation, the respective ones of the spring elements having at least one of: i) different spring deflections, and ii) different spring characteristics.

6. The high-voltage circuit breaker according to claim 5, wherein the respective ones of the spring elements have different characteristics, a first one of the respective ones of the spring elements having a least stiff spring characteristic being assigned to the respective switching rod of the one of the circuit breaker poles having a longest time delay in the event of the closing operation.

* * * * *